US008544803B2

(12) United States Patent
Ball

(10) Patent No.: US 8,544,803 B2
(45) Date of Patent: Oct. 1, 2013

(54) APPLIANCE STRAPPING SYSTEM AND METHOD

(76) Inventor: Bruce E. Ball, Gilroy, CA (US)

( * ) Notice: Subject to any disclaimer, the term of this patent is extended or adjusted under 35 U.S.C. 154(b) by 159 days.

(21) Appl. No.: 13/107,929

(22) Filed: May 15, 2011

(65) Prior Publication Data

US 2012/0284967 A1 Nov. 15, 2012

(51) Int. Cl.

| | |
|---|---|
| ***A47G 23/02*** | (2006.01) |
| *A47B 96/06* | (2006.01) |
| *E04G 3/00* | (2006.01) |
| *F16B 1/00* | (2006.01) |
| *G09F 7/18* | (2006.01) |
| *A47K 1/08* | (2006.01) |

(52) U.S. Cl.
USPC ..... 248/154; 248/229.17; 248/313

(58) Field of Classification Search
CPC .... B65F 1/141; A47G 7/025; A47G 23/0216; A47G 29/093; F17C 13/084
USPC ..... 248/500, 505, 499, 154, 493, 572, 248/42.39, 455, 460, 534, 568, 506, 510, 248/680, 681; 292/80, 262, 288; 24/302, 24/298, 265 H, 265 BC; 410/97, 100; 224/493, 224/572, 42.39, 455, 460, 534, 568
See application file for complete search history.

(56) References Cited

U.S. PATENT DOCUMENTS

| | | | | |
|---|---|---|---|---|
| 1,181,377 | A * | 5/1916 | Dowell | 410/97 |
| 2,376,336 | A * | 5/1945 | Brown | 280/834 |
| 4,004,768 | A * | 1/1977 | Evans et al. | 248/59 |
| 4,132,440 | A | 1/1979 | Johnson | |
| 5,020,760 | A | 6/1991 | Mayr | |
| 5,131,620 | A * | 7/1992 | Boundy | 248/674 |
| 5,209,533 | A | 5/1993 | Menard | |
| 5,340,250 | A * | 8/1994 | Meriwether et al. | 410/99 |
| 5,664,815 | A | 9/1997 | Kornder | |
| 5,897,086 | A | 4/1999 | Condon | |
| 5,941,623 | A * | 8/1999 | Linehan | 312/404 |
| 6,050,538 | A | 4/2000 | Marrow et al. | |
| 6,273,113 | B1 * | 8/2001 | Streyckmans | 135/88.13 |
| 6,340,143 | B1 * | 1/2002 | McCraney | 248/154 |
| 6,926,685 | B1 * | 8/2005 | Modglin | 602/5 |
| 7,103,942 | B2 * | 9/2006 | Youngberg | 24/171 |
| 7,240,890 | B1 * | 7/2007 | Pellegrino | 248/503 |
| 7,648,113 | B2 * | 1/2010 | Johnson | 248/311.2 |
| 2003/0066939 | A1 * | 4/2003 | Foreman | 248/313 |
| 2006/0147290 | A1 * | 7/2006 | Ardo | 410/100 |
| 2007/0018475 | A1 * | 1/2007 | McGinnis et al. | 296/39.1 |
| 2010/0050953 | A1 * | 3/2010 | Fails, Jr. | 119/706 |
| 2010/0140970 | A1 * | 6/2010 | Vrynois | 294/152 |

* cited by examiner

*Primary Examiner* — Daniel J Troy
*Assistant Examiner* — Muhammad Ijaz
(74) *Attorney, Agent, or Firm* — David M. Lang; Law Offices of David M. Lang

(57) ABSTRACT

A method and system to stabilize an appliance against sudden or continuous movement embodiments including one or more straps coupled to an appliance of interest and a target mounting surface. At least one spacer is located between the appliance and mounting surface. In one embodiment a plurality of straps with grommets located at the relative terminus of one end is affixed by a fastener passing through the grommet to a target mounting surface, and at least one spacer is affixed preferably to a wall stud within the target wall. A second strap end is affixed to a target appliance and tightened to provide snug contact between the appliance and wall.

8 Claims, 6 Drawing Sheets

APPLIANCE STRAPPING SYSTEM AND METHOD

FIELD OF THE INVENTION

The present invention relates generally to apparatus and methods to stabilize equipment and appliances against movement.

BACKGROUND

It is generally desirable to stabilize appliances and equipment in a specific location. Earthquakes may produce sudden and unexpected appliance movement that can result in appliance damage and damage to other property. While an earthquake is a prototypic example of sudden and unexpected movement, appliances aboard ships and aircraft may move in response to forces which overcome inertial and frictional forces keeping appliances stationary. Such movement may cause damage to the appliance, power supply cord, and other structural components. Refrigeration cooling coils, located in an appliance's rear surface, may be likewise damaged when repeated or sudden forces result in an appliance making contact with a wall. Problematic appliance movement, therefore, may be both sudden and violent as well as continuous, subtle, and insidious.

An appliance may be used (and mounted) on watercraft, aircraft, spacecraft, land based vehicle, or mounted in other locations where predictable forces will be exerted. Forces that may cause movement may be linear e.g. tending to cause movement toward or away from a target wall; horizontal sideward movement relative to a wall; and vertical sideward movement relative to a wall. In addition, forces may be non-linear or rotational, and various forces can result in rotational movement of an appliance such as movement in X, Y, and Z, (roll, pitch, and yaw) axes of rotation. In sum, rotational, non-rotational, and vibratory forces acting on an appliance may be expected, and the present invention discloses various embodiment systems and methods to address problematic appliance movement.

SUMMARY

One aspect of the present invention provides a system and method to secure appliances to a target surface. Another aspect of the present invention permits the system to be disengaged to allow an appliance to be easily moved away from a target wall for cleaning, maintenance, or repair, and then reengaged. Another aspect of the invention includes spacers placed against a target wall which make contact with the appliance to firmly secure the appliance and/or provide a shock absorbing function. Yet another aspect of the invention discloses a method to secure appliances of interest to a target surface.

DETAILED DESCRIPTION

Figure 1:
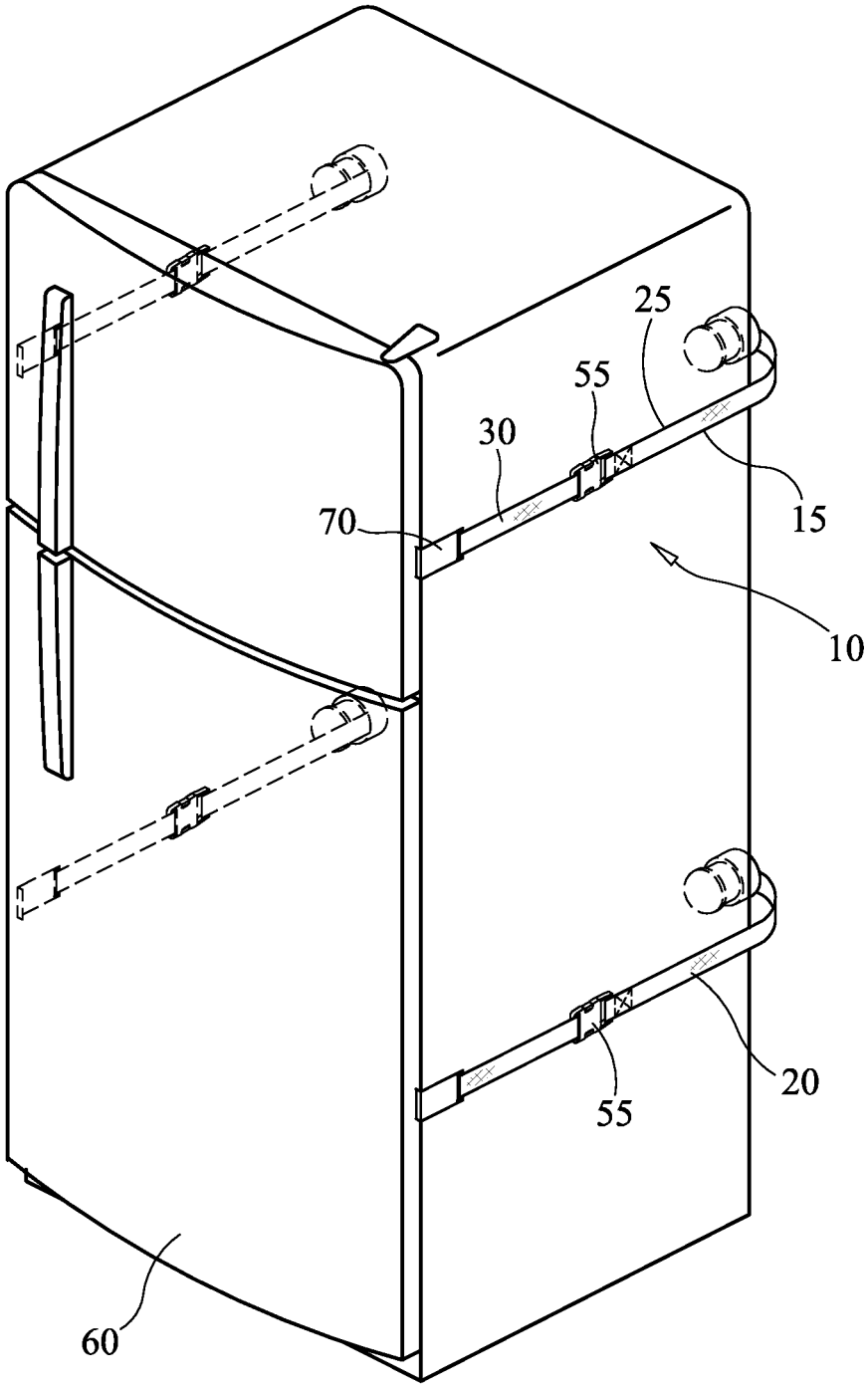
FIG. 1 is a perspective view of an embodiment of the present invention.
Figure 2:
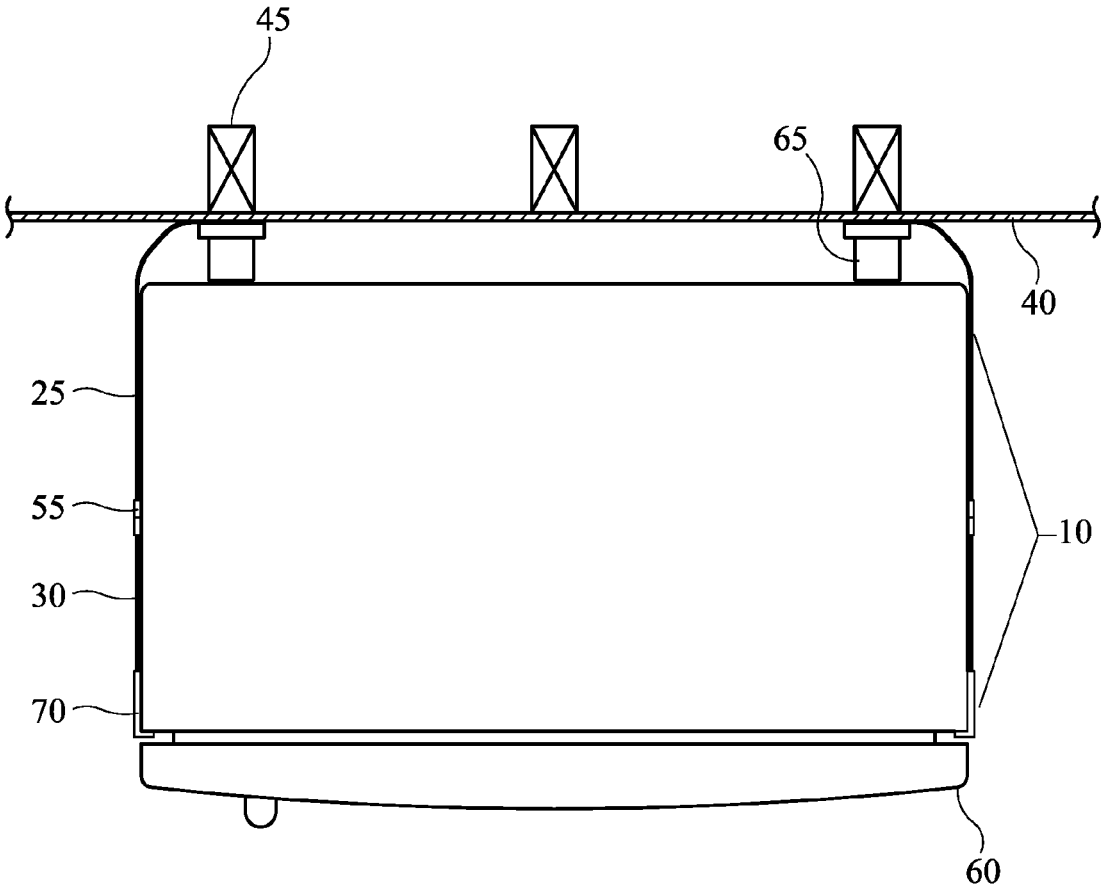
FIG. 2 is a top view of an embodiment of the present invention.

Turning now to FIGS. 1 and 2, the system has a plurality of straps 10 which in one embodiment includes an upper strap 15 and lower strap 20. Each strap 10 has a first end 25 and second end 30. As seen on FIG. 3, a grommet 35 is located through strap 10 at the relative terminus of the first end 25, permitting the first end 25 of strap 10 to be affixed to a secure surface such as a wall 40, preferably on a wall stud 45 within wall 40, by a fastener, such as screw 50 passed through grommet 35 and securely inserted within a target wall 40. Each strap 10 has a coupling 55 located between first end 25 and second end 30, the coupling 55 being capable of being reversibly engaged and disengaged.

The second end 30 of the strap 10 is affixed to a target appliance 60. In one embodiment, second end 30 is affixed to appliance adhesively. In another embodiment, second end 30 may be directly attached to appliance 60 by a fastener such as a rivet, bolt, or other semi-permanent means of affixation. In one preferred embodiment, the second end 30 of strap 10 is affixed to engaging bracket 70, which may be formed to shape a right-angled to make contact with and support appliance 60 when strap 10 is under tension.

Figure 3:
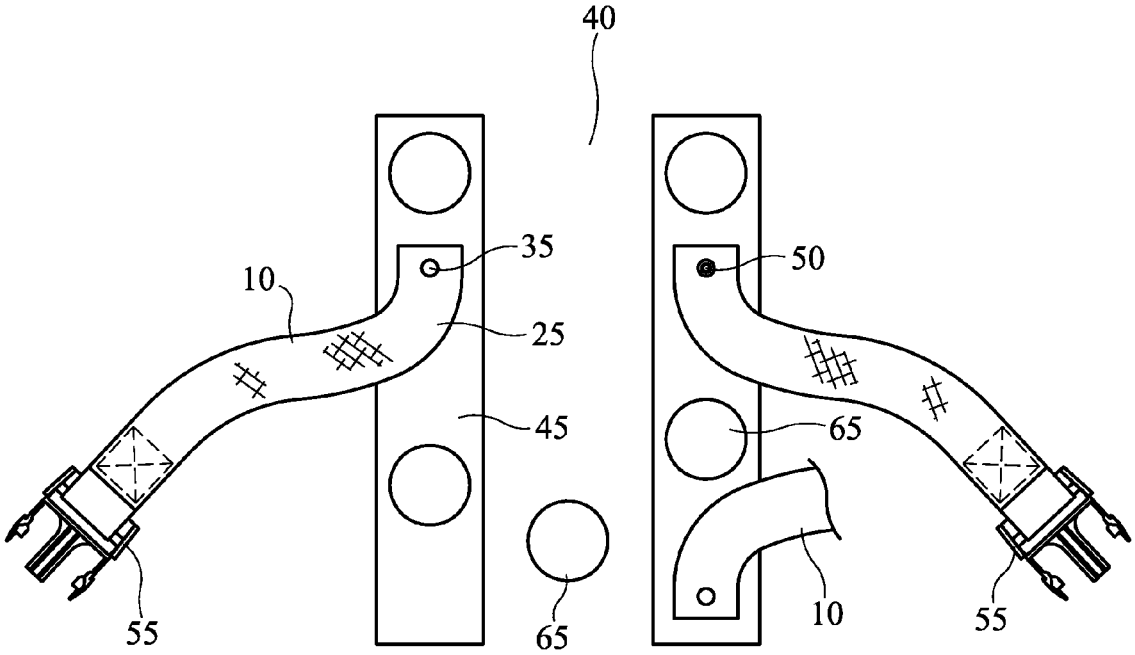
FIG. 3 is a schematic view of certain elements of an embodiment system and the target wall and studs within the target wall.
Figure 4:
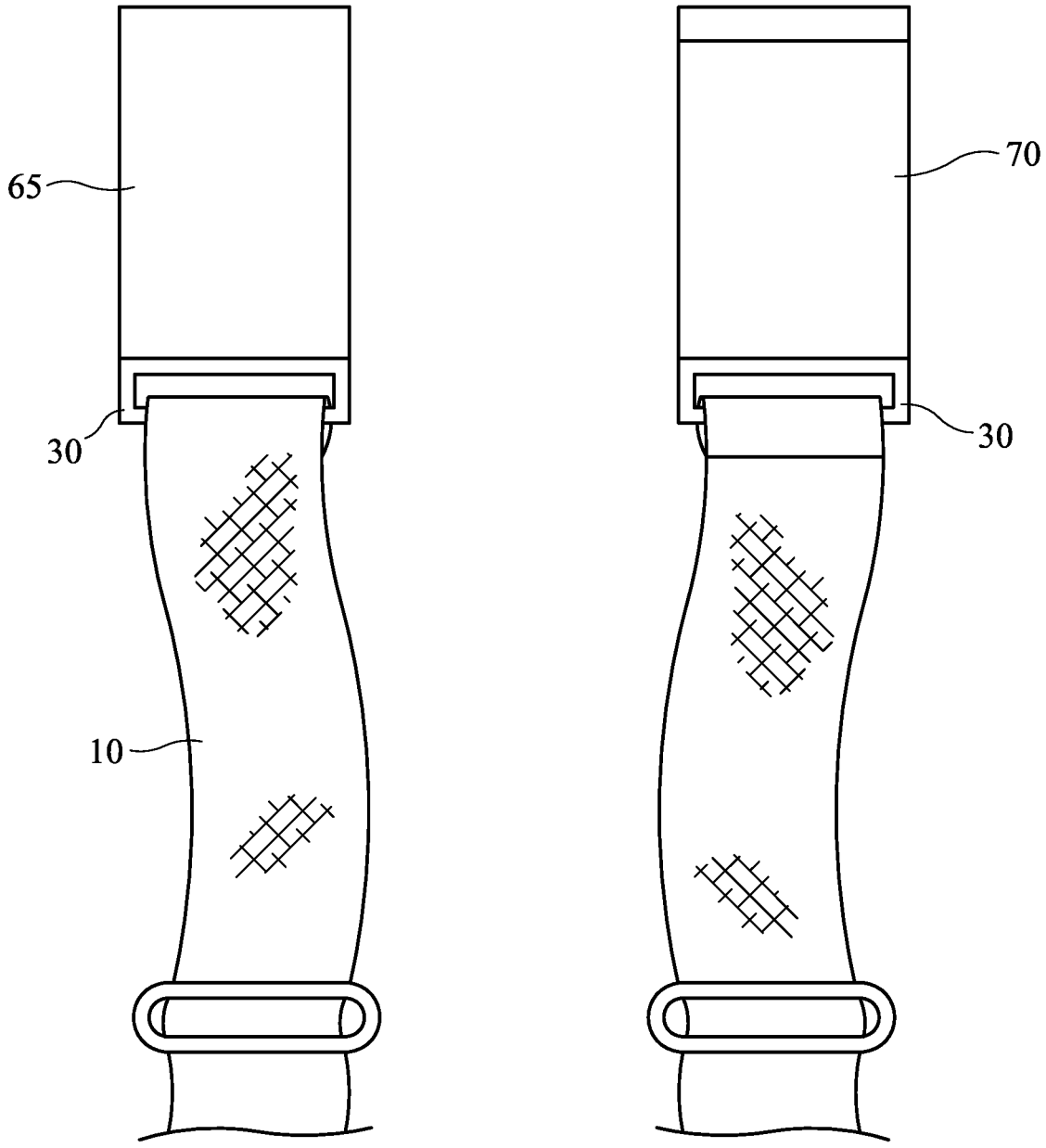
FIG. 4 is an elevation view of an embodiment system straps and engagement bracketing.
Figure 5:
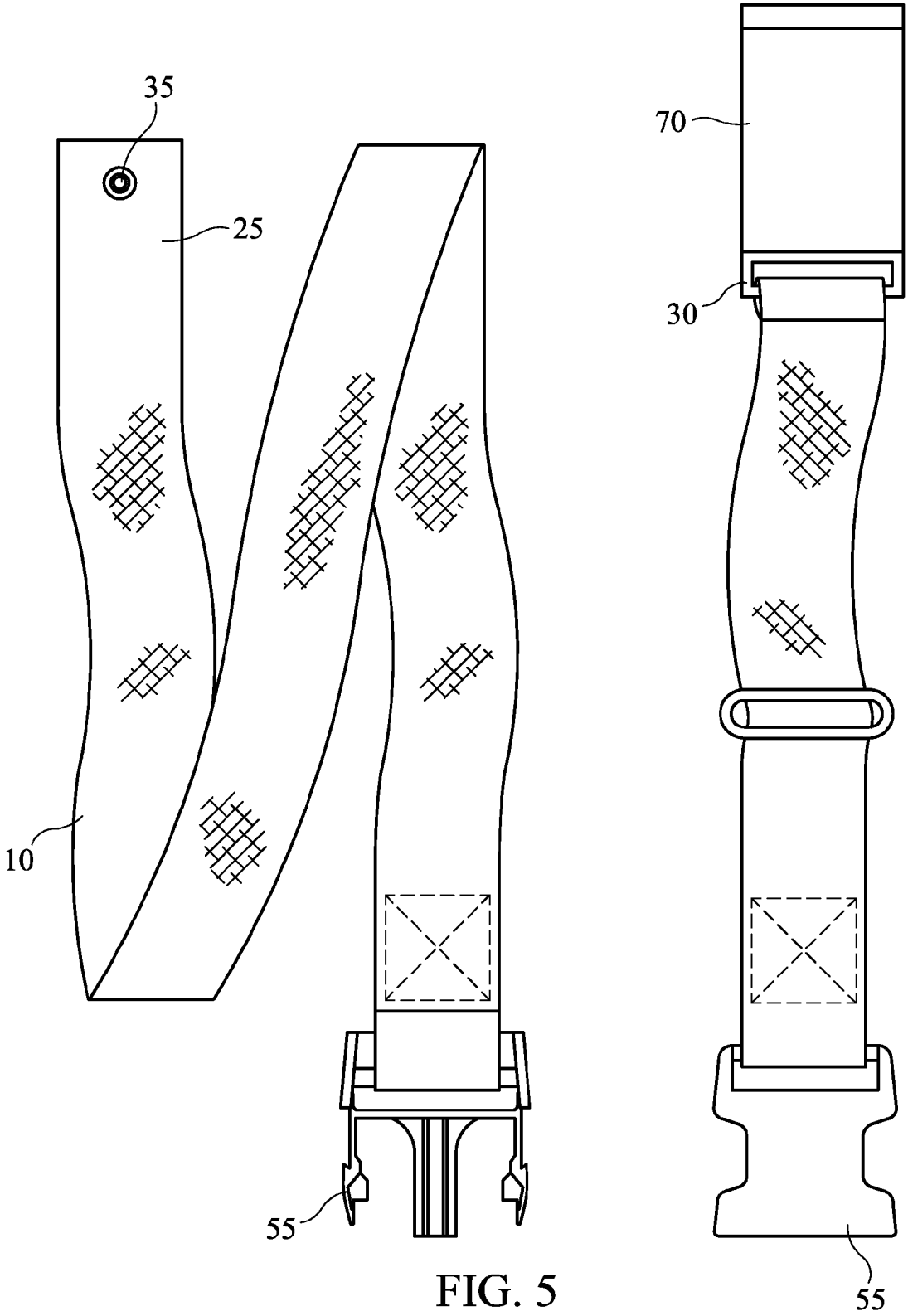
FIG. 5 is an elevation view of an embodiment system straps illustrating an embodiment coupling, grommet, and engagement bracketing.

FIGS. 1-3 illustrate at least one spacer 65 is affixed to a portion of a target wall 40. Spacer 65 may be mounted over a stud 45 on target wall 40, or affixed in an off-stud location. The spacers may be comprised of plastic, urethane, wood, rubber, foam, or other suitable material sufficient to make contact between target appliance 60 and target wall 40. In one embodiment, spacers 65 may be adhesively secured to target wall 40 and/or appliance 60. In other embodiments, spacers 65 may be friction fit between wall 40 and appliance 60. In one preferred embodiment illustrated by FIGS. 1, 2, and 6, spacers 65 and second end 25 of straps 10 may be affixed to target wall 40 at the same location.

In one non-limiting example embodiment, four straps 10 comprise the plurality. Two of the four straps 10 are affixed to the target appliance about 12 inches from the topmost surface of the appliance, and two of the four straps are affixed to the target appliance about 18 inches from the bottommost surface of the appliance. In one embodiment, two straps 10 may be coupled to appliance 60 within the upper third or quarter and two straps 10 coupled to appliance 60 within lower third or quarter of appliance 60—the upper third or quarter as being measured from appliance 60's topmost or bottommost surface respectively. In yet another embodiment, a single strap 10 may be utilized in the relative center of appliance 60 or appliance 60's relative center of mass.

Figure 6:
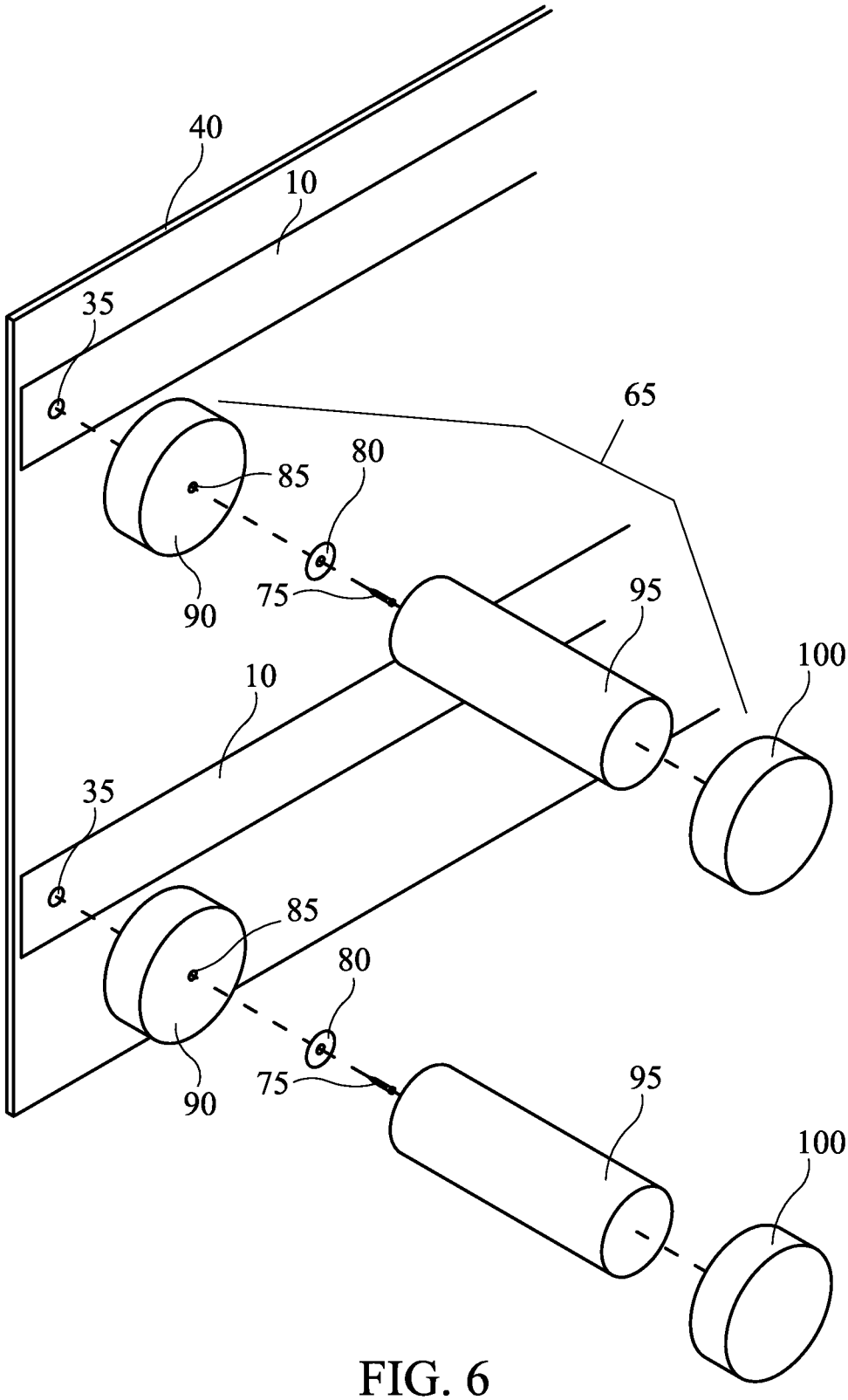
FIG. 6 is an exploded perspective view of elements of an embodiment system affixed to a target wall.

Turning to FIG. 6, two alternative and independent embodiments are illustrated.

First, in some instances, appliance 60 may be located relatively far from target wall 40. In such cases, spacer 65 may be comprised of such a length to permit a snug and secure contact between appliance 60 and wall 40. In other embodiments, spacer 65 may be integrally formed and comprised of an alternative material such as urethane, wood, relatively firm rubber, or other suitable material. It should be noted that spacer 65 length and composition will depend on a variety of circumstances such as the size of appliance 60, the required clearance of between wall 40 and appliance 60, the anticipated use of appliance 60, as well as the ground surface on which appliance 60 rests.

Second, FIG. 6 illustrates an exploded view of a desirable embodiment depicting attachment order of embodiment components wherein spacer 65 comprises a pair of end-caps and PVC extending tube. As non-limiting example, screw 75 may be passed through washer 80, through an opening 85 in first cap 90, and through grommet 35 in strap 10 and driven into stud 45 located within wall 40 (grommet hole 35 illustrated, strap omitted in FIG. 6). A first end of extending tube 95, is fit within first cap 90 and a second of extending tube 95 is fit within second cap 100. In this example embodiment, endcaps 90 and 100 and tube 95 of spacer 65 will permit a snug and secure fit between spacer 65, target wall 40, and appliance 60. Extending tube 95 and caps 90 and 100 may be comprised of PVC or a similar material.

In one embodiment, a single strap 10 may be utilized without coupling 55. In this example, the first end of strap 10 may be coupled to appliance 60. The second end is fed through a loop anchored to wall 40 and reattached to strap 10 or appliance 60 (not shown). Coupling to appliance 60 may be through bracket 70, or by adhesive means, or by a fastener such as a screw, rivet, or the like. In one embodiment, an end of a single strap 10 may be affixed to wall 40 and the second end passed through a loop anchored to appliance 60 where it may be secured by a buckle or ratchet, permitting strap 10 to be tightened allowing appliance 60 to be fastened against spacer 65.

The present application further discloses a method for stabilizing an appliance. The method includes first identifying a target appliance 60 requiring securing and then identifying target wall 40. Next, a system to secure a target appliance 60 against movement is provided, the system including a plurality of straps 10, each having a first end 25 and second end 30, wherein grommet 35 is located through strap 10 at the relative terminus of the first end 25, permitting the first end 25 of said strap 10 to be affixed to target wall 40, including stud 45, by a fastener 50 passed through grommet 35 and securely inserted within a target wall 40. Each strap 10 has a coupling 55 located between first end 25 and second end 30, the coupling 55 may be reversibly engaged and disengaged. The second end 30 of strap 10 is affixed to a target appliance 60. At least one spacer 65 affixed to a portion of a target wall 40. The user then uncouples straps 10 and identifies a spacer anchoring surface for spacer 65 on target wall 40 and affixes spacer 65 to spacer anchoring surface on wall 40. Next, the user identifies a suitable surface to locate straps 10 by selecting a wall anchoring surface on wall 40 and affixing the first end 25 of straps 10 to said wall anchoring surface. The user must find a suitable location on the appliance 60 to attach straps 10 and accordingly identifies an appliance anchoring surface on appliance 60. The user couples the second end 30 of straps 10 to the appliance anchoring surface. The user moves the appliance into the desired resting position, couples straps 10 by engaging coupling 55 and tightening straps 10 until taught. Generally, it will be desirable to have the appliance make contact with one or more spacers 65 to obtain a more secure appliance stabilization.

Importantly, as the present invention may prevent appliance movement with unexpected forces (such as an earthquake) and expected forces (such as continuous rocking on a boat), the composition of material chosen may be dependent on the forces expected to act on an appliance.

Although the present invention has been described with reference to the preferred embodiments, it should be understood that various modifications and variations can be easily made by those skilled in the art without departing from the scope and spirit of the invention. Accordingly, the foregoing disclosure should be interpreted as illustrative only and is not to be interpreted in a limiting sense. It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

What is claimed is:

1. A system to secure an appliance against movement, comprising:

a plurality of straps, each having a first end and second end, wherein a grommet is located through the each strap at the relative terminus of the first end, the first end of said strap affixed to a stud by a fastener passed through said grommet and securely inserted within a target wall, wherein each strap has a coupling located between first end and second end, said coupling being capable of being reversibly engaged and disengaged, a right-angled engaging brackets coupled to the second end of each strap, wherein said brackets make contact with and supports said appliance when said straps are under tension; at least one spacer affixed to a portion of said target wall, wherein said spacer comprises an extending tube having a first end and a second end, a first cap having an opening, wherein the first end of said extending tube is fit within first cap, a second cap, wherein second end of extending tube is fit within the second cap, extending tube, wherein the fastener is passed through a washer and then through said first cap's opening, and then through said grommet in the first end of each strap, and secured to said target wall, wherein said spacer and first end of each strap are snuggly sandwiched between the appliance and the target wall to provide tension to said brackets.

2. The system according to claim 1, wherein said plurality of straps comprises four, wherein two straps are coupled within the upper third of the appliance's topmost surface and two straps are coupled within the lower third of the appliance's topmost surface.

3. The system according to claim 2, wherein two straps are coupled to the target appliance about 12 inches from the topmost surface of said target appliance, wherein two straps are coupled to the target appliance about 18 inches from the bottommost surface of said target appliance.

4. The system according to claim 1, wherein said fastener comprises a #12 2.5 inch screw.

5. The system according to claim 1, wherein said straps are about 48 inches in length.

6. The system according to claim 1, wherein said coupling comprises a buckle.

7. The system according to claim 1, wherein said spacer is formed from PVC.

8. A method of secure an appliance against movement comprising:

identifying a target appliance requiring securing;

identifying a target wall;

providing a system to secure said target appliance against movement, said system comprising: a plurality of straps, each having a first end and second end, wherein a grommet is located through said straps at the relative terminus of the first end, the first end of said straps affixed to said stud by a fastener passed through said grommet and securely inserted within a target wall, wherein each strap has a coupling located between first end and second end, said coupling being capable of being reversibly engaged and disengaged, a right-angled engaging bracket coupled to the second end of each straps wherein said brackets make contact with and supports said appliance when said straps are under tension; at least one spacer affixed to a portion of said target wall, wherein said spacer comprises an extending tube having a first end and second end, a first cap having an opening, wherein the first end of said extending tube is fit within first cap, a second cap, wherein second end of extending tube is fit within the second cap, extending tube, wherein the fastener is passed through a washer and then through said first cap's opening, and then through said grommet in the first end of each strap, and secured to said target wall, wherein said spacer and first end of each strap are snuggly sandwiched between the appliance and said target wall to provide tension to said brackets, uncoupling said straps;

identifying an spacer anchoring surface on said target wall for said spacer;

affixing the spacer to said spacer anchoring surface;

identifying a wall anchoring surface;

affixing the first end of said straps to said wall anchoring surface;

identifying an appliance anchoring surface on said target appliance;

affixing the second end of said straps to said appliance anchoring surface;

moving appliance into resting position;

coupling said straps;

tightening said straps until taught.

* * * * *